US007672620B2

(12) United States Patent
Wegman

(10) Patent No.: US 7,672,620 B2
(45) Date of Patent: Mar. 2, 2010

(54) DEVELOPER PURIFICATION STATION OR STRUCTURE

(75) Inventor: Paul M. Wegman, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 548 days.

(21) Appl. No.: 11/634,425

(22) Filed: Dec. 6, 2006

(65) Prior Publication Data

US 2008/0138116 A1 Jun. 12, 2008

(51) Int. Cl.
*G03G 15/08* (2006.01)

(52) U.S. Cl. ..... 399/253

(58) Field of Classification Search ..... 399/253, 399/148–150, 356, 358, 359
See application file for complete search history.

(56) References Cited

U.S. PATENT DOCUMENTS 3,865,080 A * 2/1975 Hudson ..... 399/253
3,911,865 A * 10/1975 Volkers ..... 399/253
4,545,325 A * 10/1985 Komatsu et al. ..... 399/253
4,639,115 A * 1/1987 Lin ..... 399/253
5,802,430 A * 9/1998 Wada ..... 399/253
2008/0138117 A1* 6/2008 Wegman ..... 399/253

FOREIGN PATENT DOCUMENTS

JP 62067572 A * 3/1987
JP 11038673 A * 2/1999
JP 11212416 A * 8/1999

* cited by examiner

*Primary Examiner*—Susan S Lee
(74) *Attorney, Agent, or Firm*—James J. Ralabate

(57) ABSTRACT

This is a magnetic developer purification structure that is used along with other stations positioned in the path of an electrostatic moving belt or drum in an electrostatic marking system. This purification structure may be a separate station or may be part of the development station provided it supplies purified developer to the development station prior to developer contacting the latent image on the drum or belt. The purification structure will agitate the developer mix to form a homogenous mixture of toner and carrier. This mixture is magnetically treated to separate less magnetically attracted contaminants from the remainder of the mixture. The contaminants are removed from the mix and substantially pure developer is then available for contact with the latent image.

11 Claims, 2 Drawing Sheets

DEVELOPER PURIFICATION STATION OR STRUCTURE

CROSS REFERENCES TO RELATED APPLICATIONS

Illustrated and disclosed in co-pending application which is owned by the present assignee is Ser. No. 11/634,426 which, with the present, are applications relating to toner purification in an electrostatic process. The application based on Ser. No. 11/634,426 and the present application are filed concurrently herewith. The disclosures of these two applications are totally incorporated into each other herein by reference.

In Ser. No. 11/634,426, concurrently filed herewith, a purification method and a test procedure for developer for use in electrostatic marking systems is disclosed and claimed.

In the present application, a structure for purifying developer prior to the developer contacting the photoconductor in an electrostatic marking apparatus is disclosed and claimed.

FIELD

This invention relates to marking systems and, more specifically, to a structure and system for removing contaminants in said marking systems from toner and developers used prior to the development step.

BACKGROUND

In the process of electrostatographic reproduction, a light image of an original to be copied or printed is typically recorded in the form of a latent electrostatic image upon a photosensitive member with a subsequent rendering of the latent image visible by the application of electroscopic marking particles commonly referred to as toner. The visual toner image can be either fixed directly upon the photosensitive member or transferred from the member to another support medium such as a sheet of plain paper. To render this toner image permanent, the image must be "fixed" or "fused" to the paper, generally by the application of heat and pressure.

With the advent of high speed monochrome and color marking machines, including xerography reproduction machines wherein copiers or printers can produce at a rate in excess of three thousand copies per hour, the need for improved developer performance is evident and useful.

A common goal in the design and development of electrostatographic marking devices is the ability to maintain optimum image quality from page to page and job to job regardless of the characteristics of the images being formed on each page. As should be appreciated, to maintain optimum image quality, it is important that the printing device sustain good quality developer, good development as well as good transfer efficiency. Good development or good developability refers to the ability of the device to transfer the appropriate amount of high quality toner to the latent image when forming the toner powder image.

It is known that maintaining the state of the material in the developer housing within an optimum purity range improves developability and transfer efficiency. To accomplish this, many marking systems use a variety of processes to maintain the state of the developer materials within the optimum range by monitoring and controlling one or more characteristics of the materials including, for example, temperature, humidity, charge, toner concentration (ratio of toner to carrier), toner purity and toner charge distribution.

However, even if the developer materials are maintained in an optimal state, it has been observed that under certain conditions such as extended running of prints with lower toner area coverage in one or more of the color separations, the developability and/or transfer efficiency can degrade and become contaminated due to changes in the material's state in the developer housing. Foreign particles in the toner and degradation in developability and/or transfer efficiency produces weak, mottled and/or streaky images.

The analytical test that measures the amount of foreign particles and coarse toner particles in a sample of toner has been standard for many years. This test is important because the analysis links the quality of the toner to the type of print defect. This was the necessary and sufficient test that provided feedback to toner manufacturing operations to verify that quality toner is being produced. More recently, however, there has been a print defect identified that is caused by agglomerated toner or additive powder. A gently screening process was developed that is able to isolate these soft agglomerated toner particles. Unfortunately, quality problems with toners cannot be captured by this test because these new type of soft agglomerated toner particles are too friable. The particles break up with the required mechanical screening and brushing such that there are little if any retains remaining. If low levels of vacuum are used to pull material away from the screen, then even fewer retains or contamination particles can be expected resulting in a misleading analytical test result. The consensus of studying the problem is that the current analytical test is not able to segregate the soft agglomerates that are causing the print defect problem. Despite adjustments with different combinations of sample sizes, vibration, screen sizes, vacuum and brushing, these particles cannot be reliably removed and captured. So, without a reliable analytical test method, it is a great risk to begin toner manufacturing production.

In electrostatic development processes, a developer material is used comprising relatively large magnetic carrier beads that have fine toner particles electrostatically attracted to and coated thereon. Various known means are used to convey these toner particles to the latent electrostatic image on the photoconductive surface. The composition of the carrier particles is so chosen as to electrostatically attract and hold the toner particles for transfer to the latent image, preferably without contaminants. As the developer is directly or indirectly contacted into this photoconductor surface, the toner particles are electrostatically deposited and secured to the charged portion of this latent image and not deposited on the uncharged or background portion of the image. The carrier and excess toner are then recycled for later use but eventually, after extended use, become contaminated and ready to be removed from the system to be replenished with new toner and carrier. A system to extend developer life and purify the toner would be extremely economically attractive.

In magnetic brush development, bad particles, impurities, contaminants or agglomerates in the toner will separate out during development and cause dots or spots on the paper or receiving member thereby ruining the final copy. These agglomerates or impurities do not attach to the carrier because they are either or both too large in size or they do not possess a strong enough opposite tribo charge to the carrier charge. Using this knowledge, a magnetic purification process of the present invention can work in a similar fashion simulating this development process.

SUMMARY

The present embodiments provide a structure within the electrostatic marking apparatus for magnetically removing agglomerates and impurities, hereinafter "contaminants" from toner and magnetic developer. The toner containing these contaminants is mixed at a purification station with magnetic carrier to form a homogenous magnetic developer mixture. After some agitation, a magnet is placed in a magnet attracting distance from said magnetic developer mix to cause a magnetic force to be exerted on this mix. This force causes said magnetic developer to be attracted toward said magnet, and the contaminants to be less attracted to the magnet. This separates the contaminants from the developer leaving a substantially pure developer that is easily drawn off. These contaminants including impurities and agglomerates are easily disposed of. The purified developer mix can easily be separated from the impurities by any suitable means and, as noted, the impurities discarded. This purified developer in a separate purification station can then be conveyed to the development station where it contacts the photoreceptive belt for development of the image.

This purification station can be a separate station located prior to the development station and in operative connection to the development station. Alternatively, the purification structure can be located in the development station in a manner to provide purified developer in this station prior to the developer contacting the latent image on the photoconductive belt. Any suitable arrangement can be used provided the magnetic purification of the developer is accomplished prior to the developer contacting the latent image.

The contaminants removed from the developer (as described in co-pending application Ser. No. 11/634,426) can be expelled from the electrostatic marking apparatus in any convenient way including the methods shown in the Figures of Ser. No. 11/634,426.

In this manner, the contaminants originally in the mix before the developer is finally used at the development station, never contact the photoconductor to cause marks on the final copy.

In several tests, this purification process was successfully carried out in one embodiment using a magnetic developer roller similar to that used in an electrostatic marking system. Also used in another embodiment was a simple two-cup arrangement where a cup holding the developer mixture was agitated to form a homogenous developer mixture. A magnet was positioned in a magnetic attracting position to this mixture drawing out the purified magnetically attracted developer and leaving in the cup the less magnetically attracted agglomerates or other contaminants which are then discarded. A third embodiment uses a known magnetic stirrer device where, after stirring the mixture, the less magnetically attracted agglomerates or contaminants become visible. Then these impurities are removed by any suitable way and the mixture is ready to be used in the developing station of the marking apparatus.

As above noted, this purification takes place in the electrostatic marking apparatus at any convenient location prior the developer contacting the photoreceptor or photoconductive belt.

In embodiments of this invention, a novel structure and process is used for detecting and removing contaminants including the type of very soft toner agglomerates and contaminants that cause the print defects. The present embodiments use magnetic carrier that is mixed with the test toner material to form a homogenous magnetic developer mix. This process and system works by attracting and holding the correct size and charged toner particles to the magnetic carrier similarly to the process that occurs in the actual development housing of an electrostatic marking system. The problematic larger particles, be they soft agglomerated toner or additive, coarse particles or foreign particles, are not able to be triboelectrically captured by the carrier and thus "float" in the mixture. A visual inspection and analysis of the "bad" material can then proceed. As noted, this test is an accurate simulation of the mixing that occurs in an actual electrostatic development system. It accurately separates the exact type of bad contaminant particles that are the cause of print defects. There is no degradation of the particles such as occurs in any previous toner particle purification tests using vibratory sieving equipment. This inventive procedure disclosed herewith is simple and reliable and will be referred to as a process, system or apparatus that "magnetically removes" contaminants.

The problematic contaminant particles or impurities, be they soft agglomerated toner or additive, coarse particles or foreign particles are not able to be electrically attracted by the carrier but are loosely captured by the magnetic brush action of the magnetic roller or other magnet. As earlier noted, it is believed that the reason these impurities are not able to be attracted by the magnetic carrier is because of either or both of these factors: (a) a weak tribo charge of these impurities or (b) because they are too large in dimensions for the carrier to hold.

Sometimes, these toner impurities have non-uniform charges and are attracted to each other to form larger agglomerates which further cause serious print defects. Generally, any toner contaminants or impurities exceeding 30 ppm of toner are unacceptable for proper print quality. These impurities show up as black spots in monochrome systems and as different color spots (than background) in color systems.

Any suitable magnetic purification system and apparatus to magnetically isolate and remove these impurities within the scope of the present embodiments may be used including the following steps: (1) the test toner containing these contaminants is mixed with the magnetic carrier to form a substantially homogenous developer mixture, (2) this mixture is placed in a substantially flat container and the mixture gently tumbled; magnetic mixing is one form that works well, (3) this mixing process continues so that the impurities and contaminant particles clearly appear. What occurs is that placing a magnet in magnet attracting distance from the mixture causes the magnetic developer to be attracted toward the magnet and the contaminants to be less attracted, thereby separating from the magnetic developer. (4) The impurities or contaminants are then removed by any convenient way such as tape removal, weight separation, tribo separation or mixtures thereof. They may be discarded and the carrier-toner mixture, free from these impurities, is then ready for conveyance to the developer station for use in an electrostatic marking system. This magnetic purification system and apparatus is more specifically defined in the claims.

DETAILED DISCUSSION OF DRAWINGS AND PREFERRED EMBODIMENTS

Figure 1:
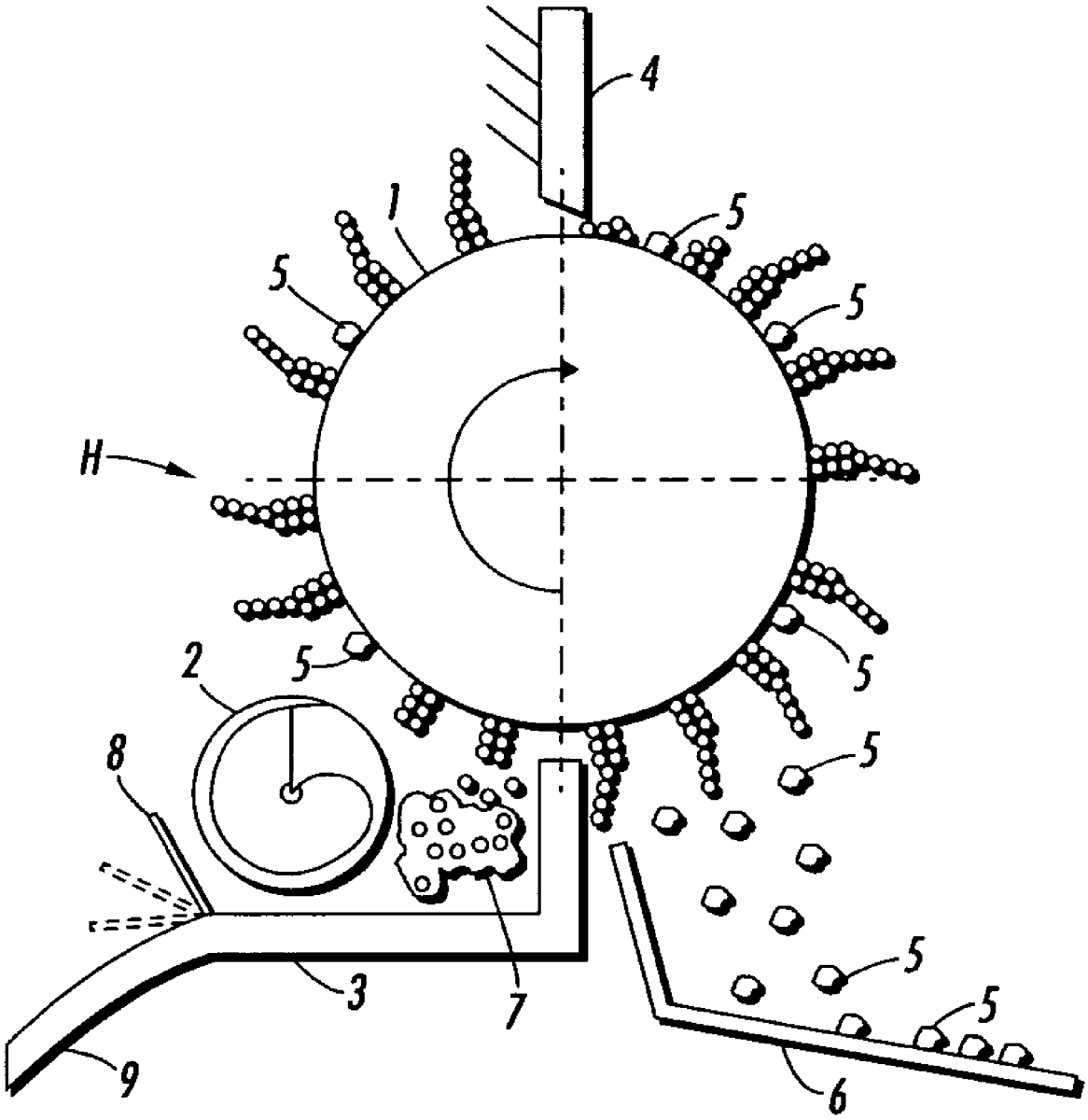
FIG. 1 illustrates an embodiment of a purification station that can be used in the present invention. This station can be used before a development station or made part of the development station.
Figure 2:
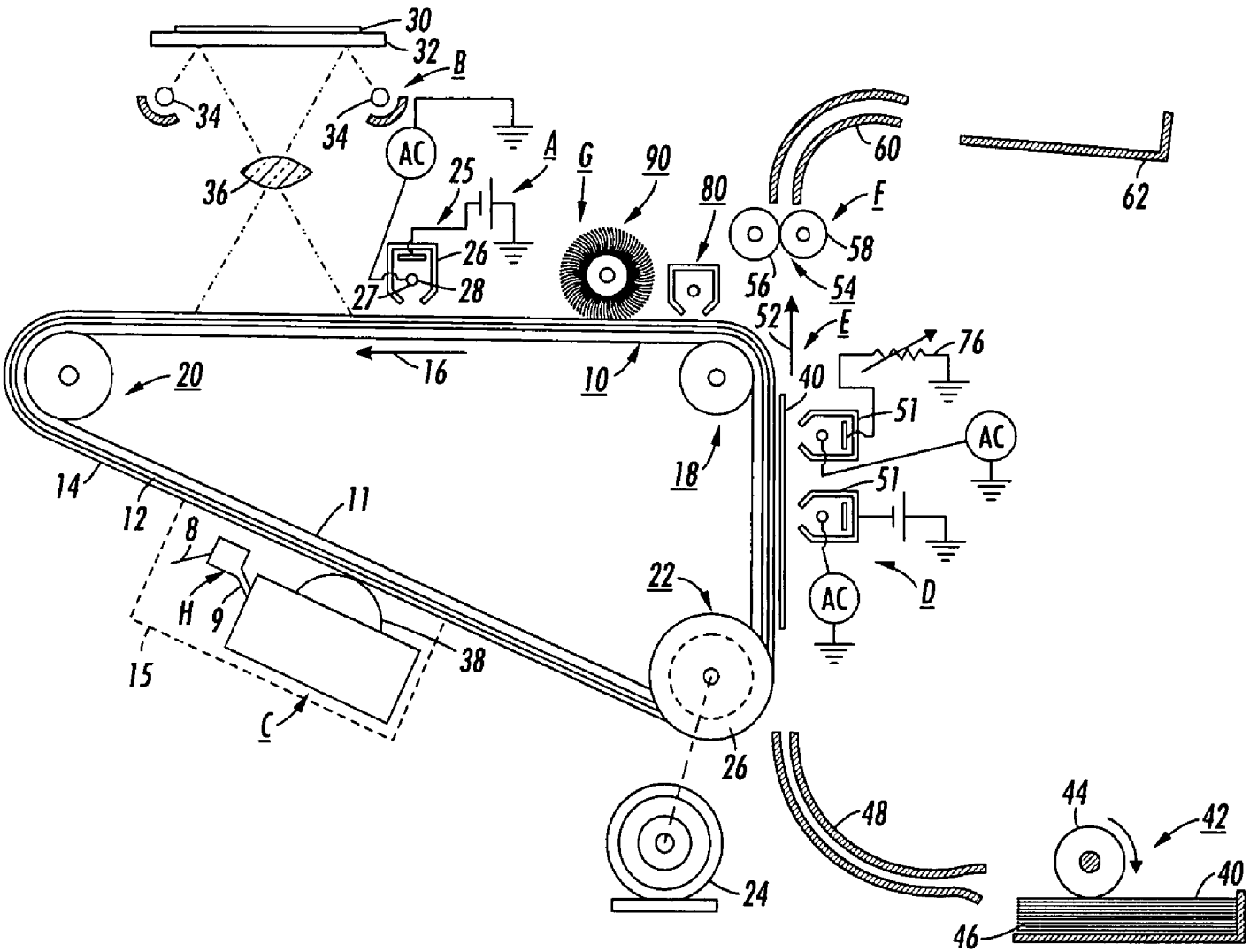
FIG. 2 schematically depicts the various components and stations of an illustrative electrophotographic machine incorporating the developer purification station of the present invention.

In FIG. 1, an embodiment of a structure useful as a separate developer purification station in an electrostatic marking system or as part of a developer station in said system is shown. In FIG. 1, a powered magnetic roll 1 is movably supported therein. The roll 1 rotates from 1-500 RPM primarily in the direction of the arrow. It may be reversed for cleaning or better expulsion of bad particles or contaminants 5. A measured developer mixture 7 of magnetic carrier with toner is placed in housing 3 with movable gate 8. An auger 2 gently mixes the two components (carrier and toner) to create a homogenous mixture 7. The auger 2 distributes the mixture 7 along the axis of magnetic roll 1. The auger 2 may or may not be geared to the magnetic roll 1 to move independently. The roll 1 rotates moving the mixture 7 under the trimmer bar 4. Particles bigger than the trimmer bar-roll gap are caught behind the trimmer bar 4. This manifests itself by disturbing the uniform magnetic brush pattern. The eventual print defects are a streak from this failure. The toner contaminant particles 5 are captured in tray 6 as they are expelled from the roll 1. The particles 5 are captured and removed from the system. The carrier toner purified mixture 7 is then conveyed from the housing 3 to the developer station C (as seen in FIG. 2). This can be done in any suitable conveyance such as a conveyor belt or a movable exit gate 8; the dotted lines at 8 indicate the various gate 8 positions, closed and open. The open gate position permits the purified developer to leave housing 3 to the developer station as indicated by the arrow. This purification procedure can be run until no more contaminants or agglomerates 5 fall from roll 1; then this purified developer is conveyed to the developer station via chute 9. As noted earlier, the purification station may be separate or integral with developer station C provided it is arranged so that the developer is purified prior to the developer contacting the latent image on the photosensitive belt 10. Because the contaminants are much less magnetically attracted to the roll 1, they will fall from the roll 1 by gravity. By "conventional stations" in an electrophotographic marking apparatus is meant the charging station, exposure station, development station, transfer station, detack station, fusing station and cleaning station. To these stations this invention adds at least one purification station integral with or in communication with the development station.

Inasmuch as the art of electrophotography is well known, the various processing stations employed in the printing machine illustrated in FIG. 2 will be described only briefly. This is the type marking system in which the purification station of this invention can be used.

As shown in FIG. 2, the machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20 and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as belt drive.

Belt 10 is maintained in tension by a pair of springs (now shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 2, initially a portion of a drum or belt 10 passes through charging station A. At charging station A, a corona device, indicated generally by the reference numeral 25, charges the belt 10 to a relatively high, substantially uniform negative potential. A suitable corona-generating device for negatively charging the photoconductive belt 10 comprises a conductive shield 26 and an dicorotron electrode comprising an elongated bare wire 27 and a relatively thick electrically insulating layer 28 having a thickness which precludes a net d.c. corona current when an a.c. voltage is applied to the corona wire and when the shield and the photoconductive surface are at the same potential. Stated differently, in the absence of an external field supplied by either a bias applied to the shield or a charge on the photoreceptor, there is substantially no net d.c. current flow.

Next, the charged portion of the photoconductive belt is advanced through exposure station B. At exposure station B, an original document 30 is positioned facedown upon transparent platen 32. Lamps 34 flash light rays onto original document 30. The light rays reflected from original document 30 form light images which are transmitted through lens 36. The light images are projected onto the charged portion of the photoconductive belt to selectively dissipate the charge thereon. This records an electrostatic latent image on the belt which corresponds to the informational area contained within original document 30. Alternatively, the exposure station B could contain an electrographic recording device for placing electrostatic images on the belt 10 in which case the corona device 25 would be unnecessary.

Thereafter, belt 10 advances the electrostatic latent image to the purification station H and then to the now purified development station C. The purification station H can be separate or can be part of the development station C as shown in dotted lines 15. Therefore, if desired, stations C and H can be combined into one structure 15. As noted, the important aspect is that station H, whether alone or in combination with station C, be located prior to the developer contacting the latent image on belt 10. At development station C, a magnetic brush developer roller 38 advances a developer mix (i.e. toner and carrier granules absent contaminants) into contact with the electrostatic latent image. Alternatively, the purification station H may be integral with or combined with the development station C provided the developer is purified before the carrier contacts said electrostatic latent image on the belt 10. The chute 9 conveys purified developer from station H to development station C. The latent image attracts the toner particles from the carrier granules thereby forming toner powder images on the photoconductive belt.

Belt 10 then advances the toner powder image to transfer station D. At transfer station D, a sheet of support material 40 is moved into contact with the toner powder images. The sheet of support material is advanced to transfer station D by a sheet-feeding apparatus 42. Preferably, sheet-feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in a timed sequence so that the toner powder image developed thereon contacts the advancing sheet of support material at transfer station D.

Transfer station D includes a corona-generating device 50 which sprays negative ions onto the backside of sheet 40 so that the toner powder images which comprise positive toner particles are attracted from photoconductive belt 10 to sheet 40. For this purpose, approximately 50 microamperes of negative current flow to the copy sheet is affected by the application of a suitable corona-generating voltage and proper bias.

Subsequent to transfer, the image sheet moves past a detack corona-generating device 51 positioned at a detack station E. At the detack station, the charges placed on the backside of the copy sheet during transfer are partially neutralized. The partial neutralization of the charges on the backside of the copy sheet reduces the bonding forces holding it to the belt 10 thus enabling the sheet to be stripped as the belt moves around the rather sharp bend in the belt provided by the roller 18. After detack, the sheet continues to move in the direction of arrow 52 onto a conveyor (not shown) which advances the sheet to fusing station F.

Fusing station F includes a fuser assembly indicated generally by the reference numeral 54 which permanently affixes the transferred purified toner powder images to sheet 40. Preferably, fuser assembly 54 includes a heated fuser roller 56 adapted to be pressure engaged with a backup roller 58. Sheet 40 passes between fuser roller 56 and backup roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

By "conventional stations" in an electrophotographic marking apparatus is meant the charging station, exposure station, development station, transfer station, detack station, fusing station and cleaning station. To these this invention adds at least one purification station integral with or in communication with the development station.

In summary, embodiments of the present invention provide an electrostatic marking apparatus comprising in an operative arrangement conventional electrophotographic stations positioned along a path of a movable photosensitive belt. The conventional stations include a magnetic brush, development station, said development station adapted to hold a magnetic developer mix and enabled to convey this developer mix into contact with a latent electrostatic image on the belt. A purification station H is positioned along the belt path at a location prior to or integral with said development station. The purification station is enabled to magnetically remove and separate contaminants from the magnetic developer mix at a time and location prior to the developer mix contacting said latent electrostatic image.

In one embodiment the purification station H is a separate station and comprises a developer evacuation chute. The chute is adapted to convey purified or contaminant-free developer from said purification station to said development station.

In another embodiment the purification station H is integral with the development station and is enabled to provide said development station with purified developer prior to said developer contacting said latent image. The purification station initially comprises a developer mix with contaminants and is enabled to magnetically agitate said mix and magnetically separate contaminants from said mix. The purification station comprises a contaminant disposal tray adapted to convey removal contaminants from said purification station and said apparatus. This purification station is adapted to continuously remove contaminants from said developer mix to reduce said contaminants in said developer mix to not more than 30 ppm of toner. Thus, the purification station is adapted to continuously discharge contaminants therefrom as said contaminants are magnetically separated from said mix. The purification station comprises a magnetic developer mix at least one auger to agitate said mix and convey said mix to a magnetic roll. The magnetic roll magnetically attracts carrier and toner while enabled to attract contaminants to substantially a lesser degree and enabled to convey said contaminants to a contaminants discharge means. This magnetic developer purification station or structure H is enabled to be positioned along the movable photosensitive belt of an electrostatic marking apparatus and enabled to be positioned along said belt at a location prior to a position where said developer mix contacts a latent electrostatic image on said belt.

The structure is enabled to magnetically separate contaminants from said mix and enabled to convey a substantially contaminant free developer mix to a developer station and a contaminant disposal adapted to convey contaminants from said station.

In one embodiment the purification structure is integral with a developer station along said belt and in another embodiment is a separate station adjacent to and in operation relationship to the developer station.

The purification station is enabled to continuously separate and dispose of said contaminants while conveying substantially contaminant-free magnetic developer to a developer station.

In a specific embodiment the magnetic developer purification structure or station is enabled to continuously remove contaminants from a magnetic developer mix. This structure comprising a developer mix containing housing, an auger in said housing, a magnetic roll in operative relationship to said auger and housing, a developer conveying chute adapted to convey substantially contaminant-free developer from said housing, and a contaminant collection means adapted to collect and dispose of said contaminants from said structure, said structure being a stand-alone or separate component.

This purification structure is enabled to continuously dispose of said contaminants while conveying substantially contaminant-free magnetic developer to a developer station.

The purification station is adapted to continuously remove contaminants from said developer mix to reduce said contaminants in said developer mix to not more than 30 ppm of toner.

This purification station comprises a magnetic developer mix at least one auger to agitate said mix and convey said mix to a magnetic roll, said magnetic roll magnetically attracting carrier and toner while enabled to attract contaminants to a lesser degree and enabled to convey said contaminants to a contaminants discharge means.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims:

What is claimed is:

1. An electrostatic marking apparatus comprising in an operative arrangement:

conventional electrophotographic stations positioned along a path of a movable photosensitive drum or belt, said conventional stations including a magnetic brush development station, said development station configured to hold a magnetic developer mix and configured to convey this developer mix into contact with a latent electrostatic image on said drum or belt, a purification station positioned along said drum or belt path at a location prior to or integral with said development station, said purification station configured to magnetically separate and remove contaminants from said magnetic developer mix at a time prior to said developer mix contacting said latent electrostatic image.

2. The marking apparatus of claim 1 wherein said purification station is a separate station and comprises a developer evacuation chute, said chute configured to convey purified or contaminant-free developer to said development station.

3. The marking apparatus of claim 1 wherein said purification station is integral with said development station and is configured to provide said development station with purified developer prior to said developer contacting said latent image.

4. The marking apparatus of claim 1 wherein said purification station initially comprises a developer mix with contaminants and is configured to agitate said mix and magnetically separate contaminants from said mix.

5. The marking apparatus of claim 1 wherein said purification station comprises a contaminant disposal tray configured to convey removal contaminants from said purification station.

6. The marking apparatus of claim 1 wherein said purification station is configured to continuously remove contaminants from said developer mix to reduce said contaminants in said developer mix to not more than 30 ppm of toner.

7. The marking apparatus of claim 1 wherein said purification station is configured to continuously discharge contaminants therefrom as said contaminants are magnetically separated from said mix.

8. The marking apparatus of claim 1 wherein said purification station comprises:

a magnetic developer mix, at least one auger to agitate said mix and convey said mix to a magnetic roll, said magnetic roll magnetically substantially attracting carrier and toner while less able to attract said contaminants, and configured to convey said contaminants to a contaminants discharge means.

9. A magnetic developer purification station or structure configured to be positioned along a movable photosensitive belt or drum of an electrostatic marking apparatus, said purification station configured to be positioned along said belt or drum at a location prior to a position where developer mix contacts a latent electrostatic image on said belt or drum, and wherein said purification station or structure is configured to comprise components that magnetically substantially attract an electrostatic developer and not contaminates, and magnetically separate said contaminants from said mix, and configured to convey a substantially contaminant free developer mix to a developer station.

10. A magnetic developer purification structure or station configured to remove contaminants from a magnetic developer mix, said structure or station comprising:

a developer mix containing housing, an auger in said housing, a magnetic roll in operative relationship to said auger and housing, a developer conveying chute configured to convey substantially contaminant free developer from said housing, and a contaminant collection means configured to collect and dispose of said contaminants from said structure or station, said structure or station being a stand alone or separate component, said magnetic roll configured to substantially attract said developer, said contaminants less enabled to be attracted to said magnetic roll, and wherein said purification structure or station is configured to continuously remove contaminants from said developer mix to reduce said contaminants in said developer mix to not more than 30 ppm of toner.

11. The purification structure or station of claim 10 wherein said purification structure or station comprises:

a magnetic developer mix, at least one auger to agitate said mix and convey said mix to a magnetic roll, said magnetic roll magnetically attracting magnetic carrier and toner while configured to attract contaminants to a lesser degree, and configured to convey said contaminants to a contaminants discharge means, and to convey said developer mix to a developer station.

* * * * *